US005195909A

United States Patent [19]

Huss, Jr. et al.

[11] Patent Number: 5,195,909

[45] Date of Patent: Mar. 23, 1993

[54] INSULATIVE BACKSHELL SYSTEM PROVIDING STRAIN RELIEF AND SHIELD CONTINUITY

[75] Inventors: John P. Huss, Jr., Harrisburg; Michael E. Shirk, Grantville, both of Pa.

[73] Assignee: AMP Incorporated, Harrisburg, Pa.

[21] Appl. No.: 846,639

[22] Filed: Mar. 5, 1992

[51] Int. Cl.[5] ..... H01R 13/58; H01R 13/648

[52] U.S. Cl. ..... 439/465; 439/610

[58] Field of Search ..... 439/610, 465, 467

[56] References Cited

U.S. PATENT DOCUMENTS

| | | | |
|---|---|---|---|
| 3,977,755 | 8/1976 | Edel et al. | 439/610 |
| 4,457,576 | 7/1984 | Cosmos et al. | 439/610 |
| 4,582,384 | 4/1986 | Frantz et al. | 439/610 |
| 4,585,292 | 4/1986 | Frantz et al. | 439/736 |
| 4,641,906 | 2/1987 | Olsson | 439/610 |
| 4,722,022 | 1/1988 | Myers et al. | 439/620 |
| 4,781,615 | 11/1988 | Davis et al. | 439/395 |
| 4,842,547 | 6/1989 | Defibaugh et al. | 439/460 |
| 4,889,497 | 2/1989 | Riches | 439/610 |
| 4,921,441 | 5/1990 | Sauder | 439/460 |
| 4,952,168 | 8/1990 | Schieferly et al. | 439/467 |
| 5,108,313 | 4/1992 | Adams | 439/610 |

FOREIGN PATENT DOCUMENTS

| | | | |
|---|---|---|---|
| 2227131 | 7/1990 | United Kingdom | 439/610 |

OTHER PUBLICATIONS

Instruction Sheet 6609 Released Nov. 7, 1986; AMP Incorporated; AMP Amplimite High Density P-20 Shielded Cable Clamp Kits.

Instruction Sheet 9238 Released Aug. 27, 1986; AMP Incorporated; AMP Universal Cable Clamp Kits for Amplimite Connectors.

*Primary Examiner*—Gary F. Paumen

*Attorney, Agent, or Firm*—David L. Smith

[57] ABSTRACT

An electrical connector (20) for terminating to conductors (220) of a shielded cable (222) is prepared with an exposed cable shield (224). An insulated housing member (30) has a cavity (64) therein with a cable exit (66) extending between the cavity (64) and an exterior surface of the housing member (30). A shield member (26) is receivable in the cavity (64). The shield member (26) has a flange (190) extending into the cable exit (66). A staple (32) is adapted to be received and secured in the cable exit (66). The staple (32) is further adapted to be moved into the cable exit (66) to compress a cable (222) passing therethrough such that the shield member flange (190) is pressed into engagement with the exposed cable shield (224) on the cable (222). Strain relief is thereby provided and simultaneously electrical continuity is achieved between the cable shield (222) and the flange (190).

24 Claims, 14 Drawing Sheets

INSULATIVE BACKSHELL SYSTEM PROVIDING STRAIN RELIEF AND SHIELD CONTINUITY

BACKGROUND OF THE INVENTION

This invention relates to providing an insulative backshell for a connector yet maintaining strain relief and shield continuity from the braid shield of a shielded cable through a shield member in a connector to the shell of the connector, and in particular to providing a strain relief that simultaneously provides strain relief to a shielded cable terminated to an electrical connector and electrical continuity between the cable shielding and the shield surrounding the connector.

When conductors of a cable are electrically terminated to contacts on a connector, strain relief arrangements are utilized to prevent forces on the cable from being transmitted to the conductor to contact terminations. The cable is typically secured to the housing to transfer forces to which the cable is subjected thereto.

Good strain relief of a cable terminated to a connector requires proper compression of the cable. Too much compression can reduce the cross sectional area of conductor strands, or in the extreme severe conductor strands, while too little compression of the cable permits undesirable movement of the cable within the strain relief structure. Prior art strain relief systems have used latching segments in serrated form which engage corresponding segments only at stepped locations. These strain relief systems, which require movement of fingers in a direction perpendicular to the cable axis, lock into place only after excessive compression of the cable. Various bolted strain relief systems have been used but typically have multiple parts that must be attached to a connector.

It would be desirable to have a strain relief system for a connector having an insulative housing with internal shield members that could establish and maintain electrically continuity between the cable shielding and the shielding surrounding the connector.

SUMMARY OF THE INVENTION

In accordance with the present invention, an electrical connector for terminating to conductors of a shielded cable is prepared with an exposed cable shield. An insulated housing member has a cavity therein with a cable exit extending between the cavity and an exterior surface of the housing member. A shield member is receivable in the cavity. The shield member has a flange extending into the cable exit. A staple is adapted to be received and secured in the cable exit. The staple is further adapted to be moved into the cable exit to compress a cable passing therethrough such that the shield member flange is pressed into engagement with the exposed cable shield on the cable. Strain relief is thereby provided and simultaneously electrical continuity is achieved between the cable shield and the flange.

DESCRIPTION OF THE PREFERRED EMBODIMENT

Figure 1:
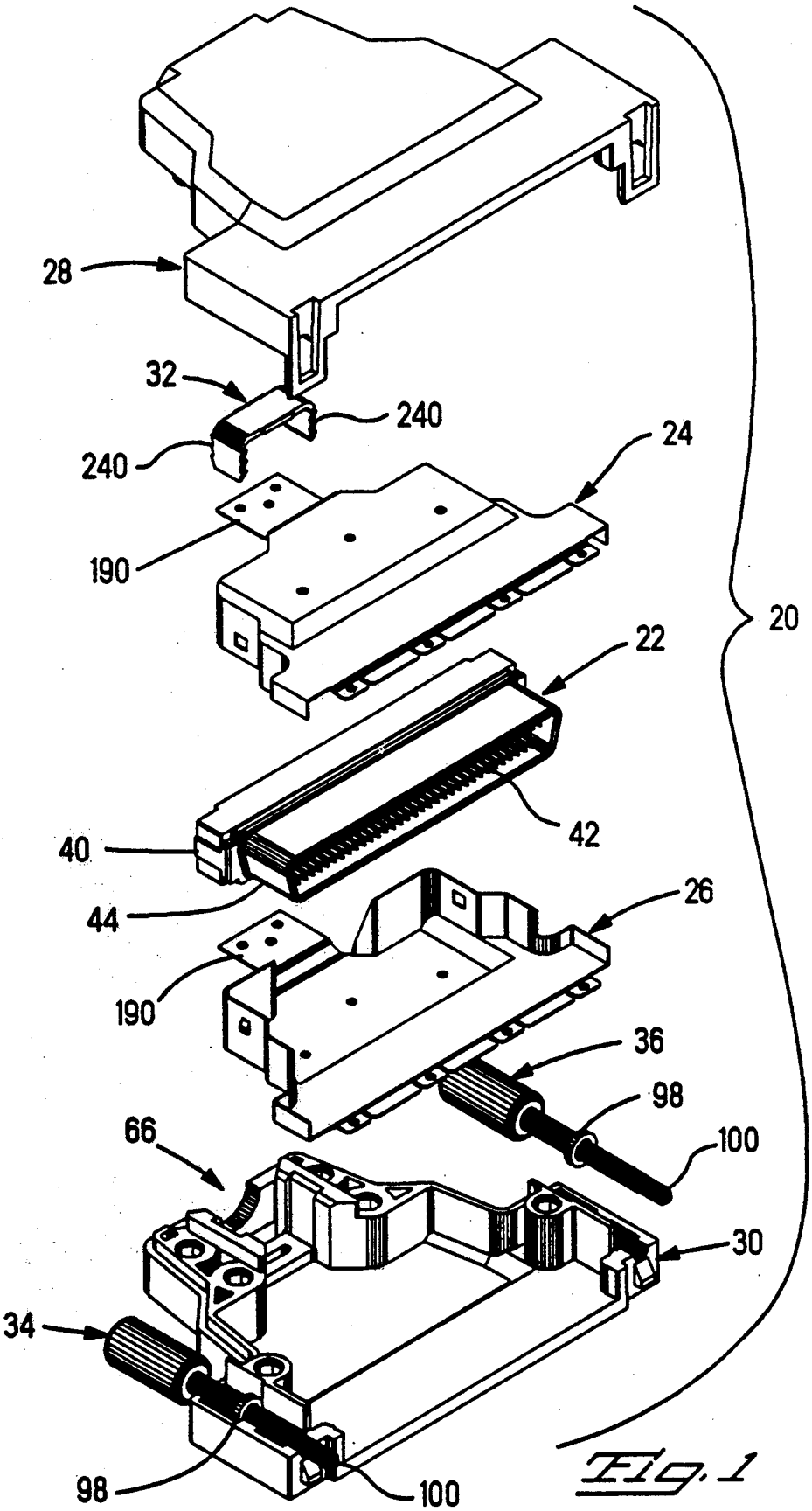
FIG. 1 is an exploded front perspective view of the connector in accordance with the present invention.

A connector 20 in accordance with the present invention is shown in the exploded perspective view of FIG. 1. In the preferred embodiment, connector 20 includes contact holding member 22, upper and lower electrically conductive shields 24 and 26, upper and lower backshells or cover members 28 and 30, and staple 32. Connector 20 may also include jack screws 34 and 36. A connector 20 terminated to a cable is shown in the perspective view of FIG. 2.

Contact holding member 22 has an insulative housing 40 which holds a plurality of conductor terminable contacts 42 and a shielding shell 44 forming a shroud surrounding the array of mating portions of the contacts. Contact holding member 22 may be any known contact holding member, such as the contact holding member disclosed in U.S. Pat. No. 4,781,615, the disclosure of which is hereby incorporated by reference, which is the preferred embodiment for the contact holding member 22.

Figure 3:
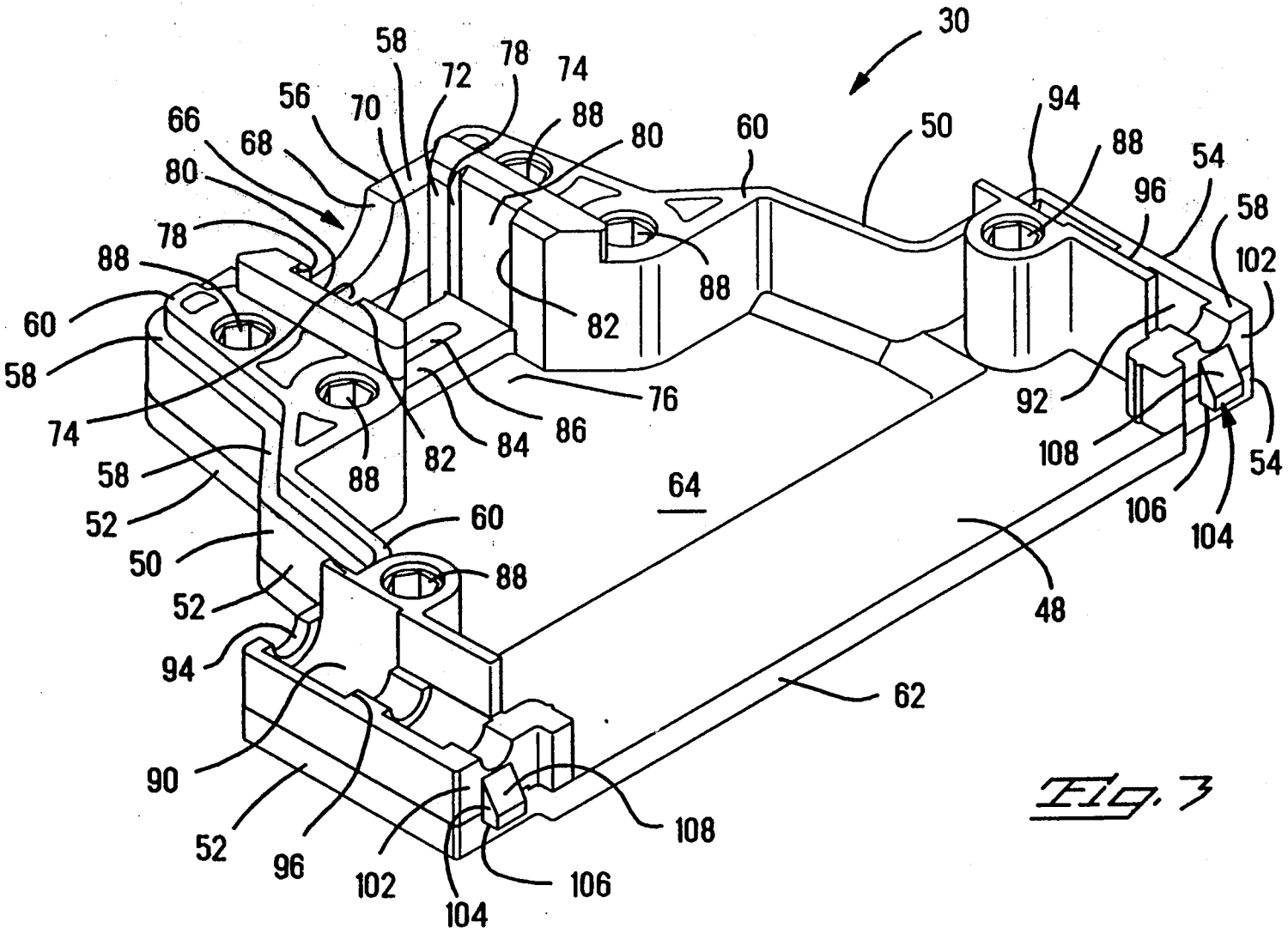
FIG. 3 is a perspective view of a lower backshell showing the internal cavity thereof.
Figure 4:
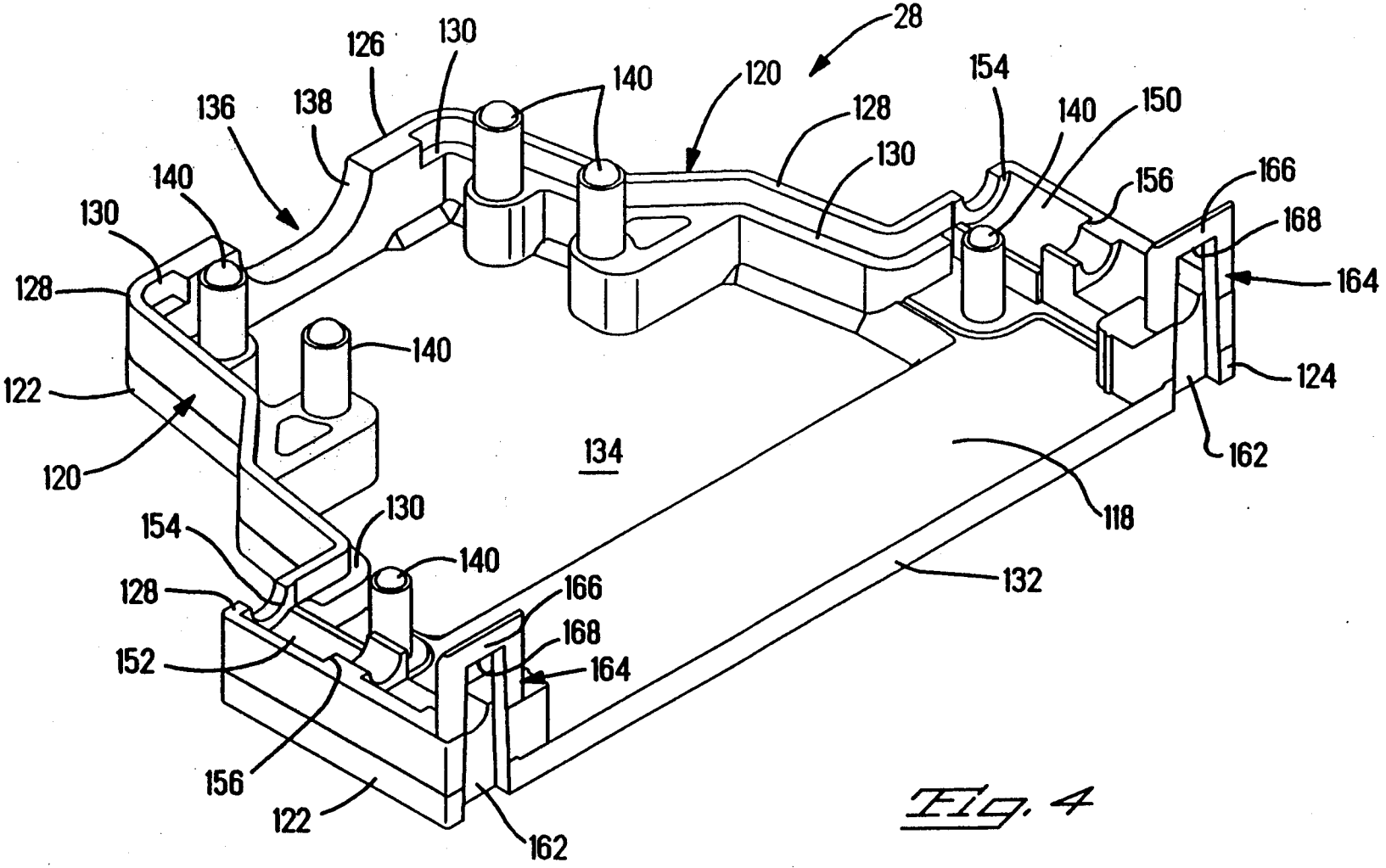
FIG. 4 is a perspective view of the upper backshell showing the internal cavity thereof.

A perspective view of lower backshell or cover member 30 is shown in FIG. 3. A perspective view of upper backshell or cover member 28 is shown in FIG. 4. Backshells 28 and 30 are molded of a suitable thermoplastic. Lower backshell 30 has a major sidewall 48 and (relative to the orientation shown in FIG. 3) an upwardly extending peripheral flange 50 extending along lateral sides 52 and 54 as well across rear wall 56. Flange 50 may have an offset upper surface providing lower surface 58 and upper surface 60. By choice of the relative locations of surfaces 58 and 60, a center seam can be achieved which emulates an overmolded connector. Between the flange along sides 52 and 54 and rearward of forward edge 62, lower backshell 30 defines a cavity 64 for receiving the lower shield 26. Rearward of cavity 64 is a cable exit 66 including a semicylindrical aperture 68 in rear wall 56. Cable exit 68 is bounded by opposed sides 70 and 72, each having a staple leg receiving channel 74 therein, and a bottom abutment surface 76. The top is preferably left open to better receive staple 32. Each staple leg receiving channel 74 is defined by a forward facing sidewall 78, an inward facing sidewall 80 and a rearward facing sidewall 82. Channels 74 are substantially as disclosed in U.S. Pat. No. 4,842,547, the disclosure of which is hereby incorporated by reference. It is desirable to space sides 72 and 70 closer together in lower backshell 30 with the result that sidewalls 78 and 82 are slightly deeper than in the prior art die cast backshell due to the thermoplastic deforming more readily upon insertion of staple 32. A transverse boss 84 may extend upwardly from surface 76 and may have a transverse recess or groove 86 therein.

Along sides 52 and 54 are a series of polygonal recesses 88 for receiving posts on the upper backshell 28 to secure the two backshells together. Along each side 52 and 54, proximate forward edge 62 is a semicylindrical jack screw receiving channel 90,92 respectively. Each jack screw receiving channel 90,92 has a forward facing rear stop 94 and a rearward facing forward stop 96. A jack screw 34,36 is receivable in a respective channel 90,92. Each jack screw has a centrally located enlarged radial region 98 rearward of distal end 100 (see FIGS. 1 and 11) which permits limited axial movement of the jack screw in the channel with region 98 movable between stop 94, where end 100 is substantially flush with surface 102, and stop 96 where end 100 extends forward of surface 102 to threadingly engage a mating connector (not shown) for securing the mating connector to connector 20.

A latch protrusion 104 extends forwardly of surface 102. Protrusion 104 has a downwardly facing (as shown in FIG. 3) latch surface 106 extending substantially normal to surface 102 and a ramped surface 108 extending outwardly and downwardly from surface 102 thereto.

FIG. 4 shows a perspective view of upper backshell or cover member 28. This upper backshell is very similar to and complimentary to lower backshell 30. Upper backshell 28 as shown in FIG. 4 is rotated 180 degrees from the view shown in FIG. 1.

Upper backshell 28 has a major sidewall 118 and (relative to the orientation shown in FIG. 4) an upwardly extending peripheral flange 120 extending along lateral sides 122 and 124 as well as across rear wall 126. Flange 120 may have an offset in the upper surface thereof providing upper surface 128 and lower surface 130 complimentary with surfaces 58 and 60, respectively, of lower backshell 30. Between the flange along sides 122 and 124 and rearward of forward edge 132, upper backshell 28 defines a cavity 134. Rearward of cavity 134 is a cable exit 136 including a semi cylindrical aperture 138 in rear wall 126.

Along sides 122 and 124 are a series of cylindrical posts 140, positioned to be received in recesses 88 of lower backshell 30. Posts 140 are typically sized and shaped to be received in recesses 88 in an interference fit to secure the two backshells together.

Along each side 122 and 124, proximate forward edge 132, is a semi cylindrical jack screw receiving channel 150,152 respectively. Each jack screw receiving channel 150,152 has a forward facing rear stop 154 and a rear facing forward stop 156. A jack screw is partial enveloped in each. The centrally located enlarged radial region 98 rearward of distal ends 100 on the jack screws permits limited axial movement of the jack screw in the channel with region 98 moveable between stop 154 where end 100 of the jack screw is substantially flush with surface 162, and stop 156 where end 100 extends forward of surface 162 to threadingly engage a mating connector.

A latch 164 extends upwardly from surface 162 and defines cross member 166 having downwardly facing latch shoulder 168 thereon.

Figure 5:
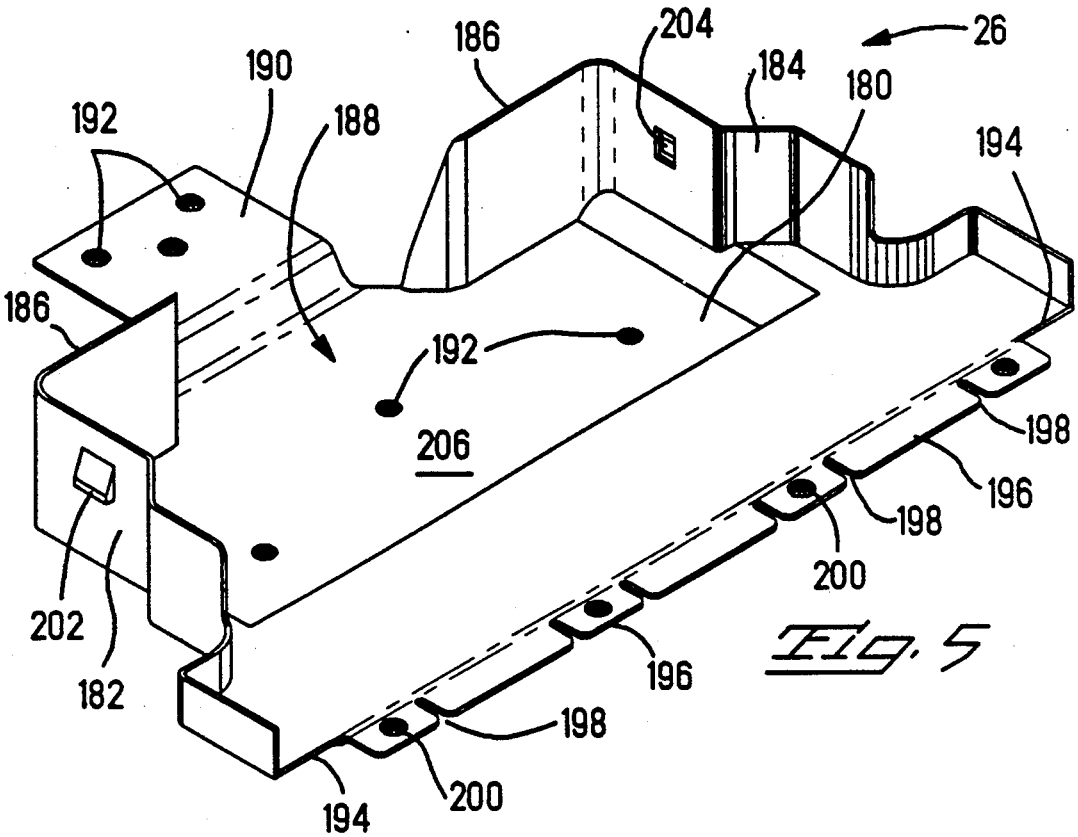
FIG. 5 is a perspective view of a lower shield showing the internal cavity thereof.
Figure 6:
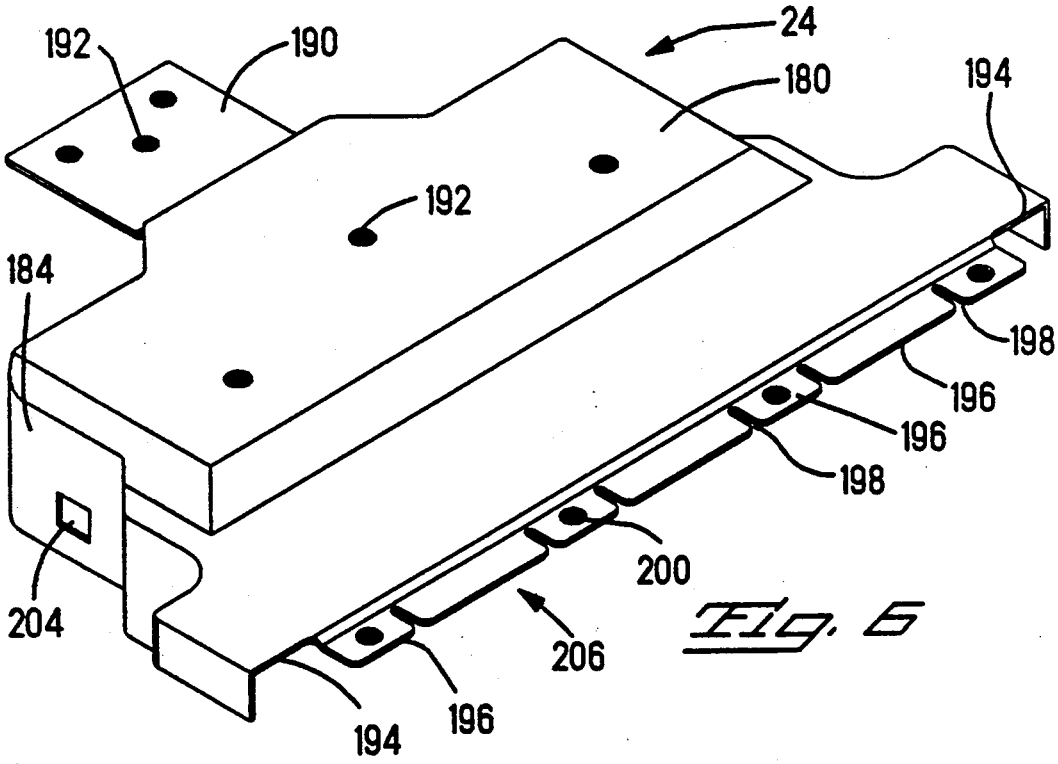
FIG. 6 is a perspective view of an upper shield showing a perspective view of the external surface thereof.

FIGS. 5 and 6 are perspective views of lower and upper shields 26 and 24. In the preferred embodiment, shields 24 and 26 are hermaphroditic so FIGS. 5 and 6 may be considered to be different perspective views of the same shield and any description of one of the shields applies equally to the other shield. While the shields described herein are hermaphroditic, the invention is not limited thereto. Two non-hermaphroditic shields, or a single shield (such as disclosed in U.S. Pat. No. 4,457,576 the disclosure of which is hereby incorporated by reference), would be considered with the scope of the invention. In the preferred embodiment, shields 24 and 26 are drawn steel then tin plated. Any suitable electrically conductive material and process of making a shield would suffice. Shields, including hermaphroditic shields, are disclosed in U.S. Pat. Nos. 4,585,292 and 4,722,022, the disclosures of which are hereby incorporated by reference.

Shields 24 and 26 have an outer sidewall 180. Extending substantially normal to sidewall 180 from and along lateral side edges thereof are sidewalls 182 and 184 which fold around the rear edge to form rear wall 186 having a cable passage 188 therein. Extending from the rear of outer sidewall 180 in the region of cable passage 188 is an integral flange 190. Flange 190 and outer sidewall 180 may have dimples 192 to prevent large areas from not being plated during the plating process.

In the preferred embodiment, proximate the forward edge 194 of outer sidewall 180, sidewalls 182 and 184 are reduced in height to about one-half of the height at the rear. When fully assembled as connector 20, the reduced height portions of the sidewalls substantially abut to provide a full shielding.

Figure 15:
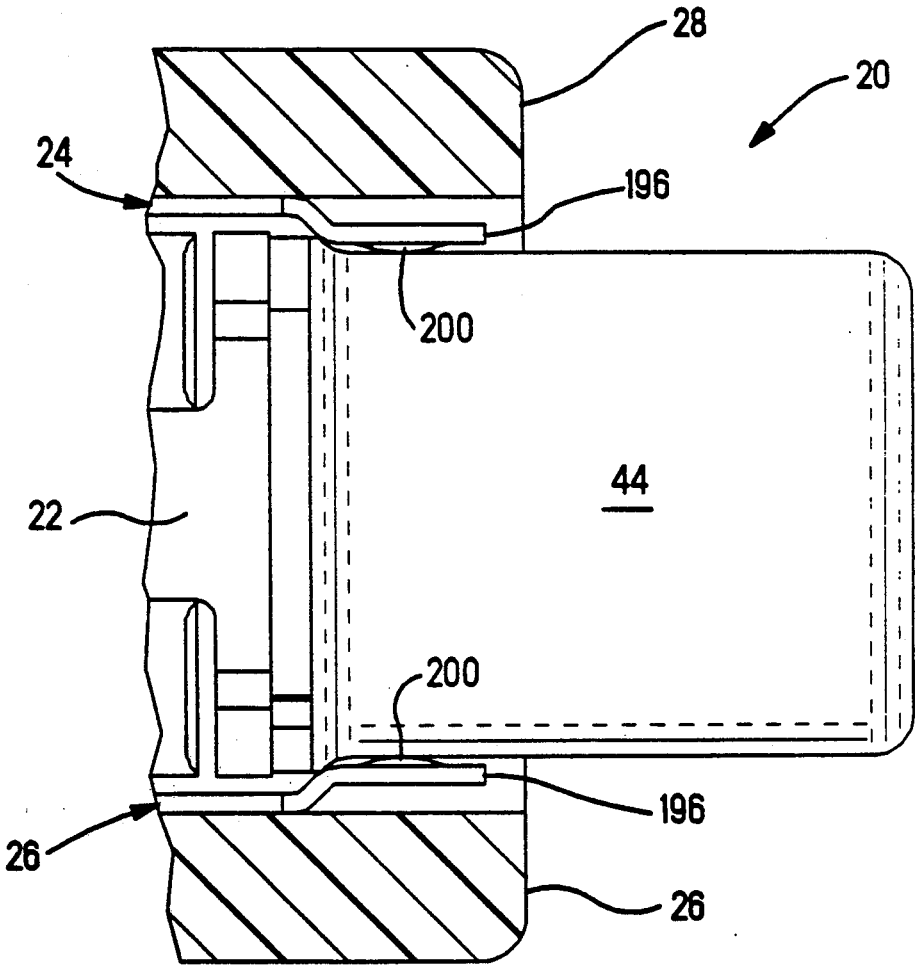
FIG. 15 is a partial sectional view of the assembled connector, on an enlarged scale, showing engagement between the upper and lower shields and the shell on the contact holding member.

Integral with and extending forwardly from forward edge 194 are spring fingers 196 separated by slots 198. Spring fingers 196 are typically formed out of the plane of outer sidewall 180 at forward edge 194, upward in FIG. 5 and downward in FIG. 6, to assure engagement with shell 44 on housing 40 as best seen in FIG. 15. Spring fingers 196 may have a boss 200 to provide selective locations where the spring fingers have enhanced engagement with shell 44.

The rear portion of sidewalls 182,184 have latch means cooperable with complimentary latch means on another shield to be secured thereto, to temporarily secure the two shields together. Aperture 202 in sidewall 184 of one shield cooperates with protrusion 202 in sidewall 182 in another shield to temporarily secure the two shields together during assembly of connector 20, as disclosed in U.S. Pat. No. 4,585,292. Between sidewalls 182 and 184 forward of cable passage 188, shields 24 and 26 define a cavity 206 for receiving housing 40 and conductors 220.

Figure 7:
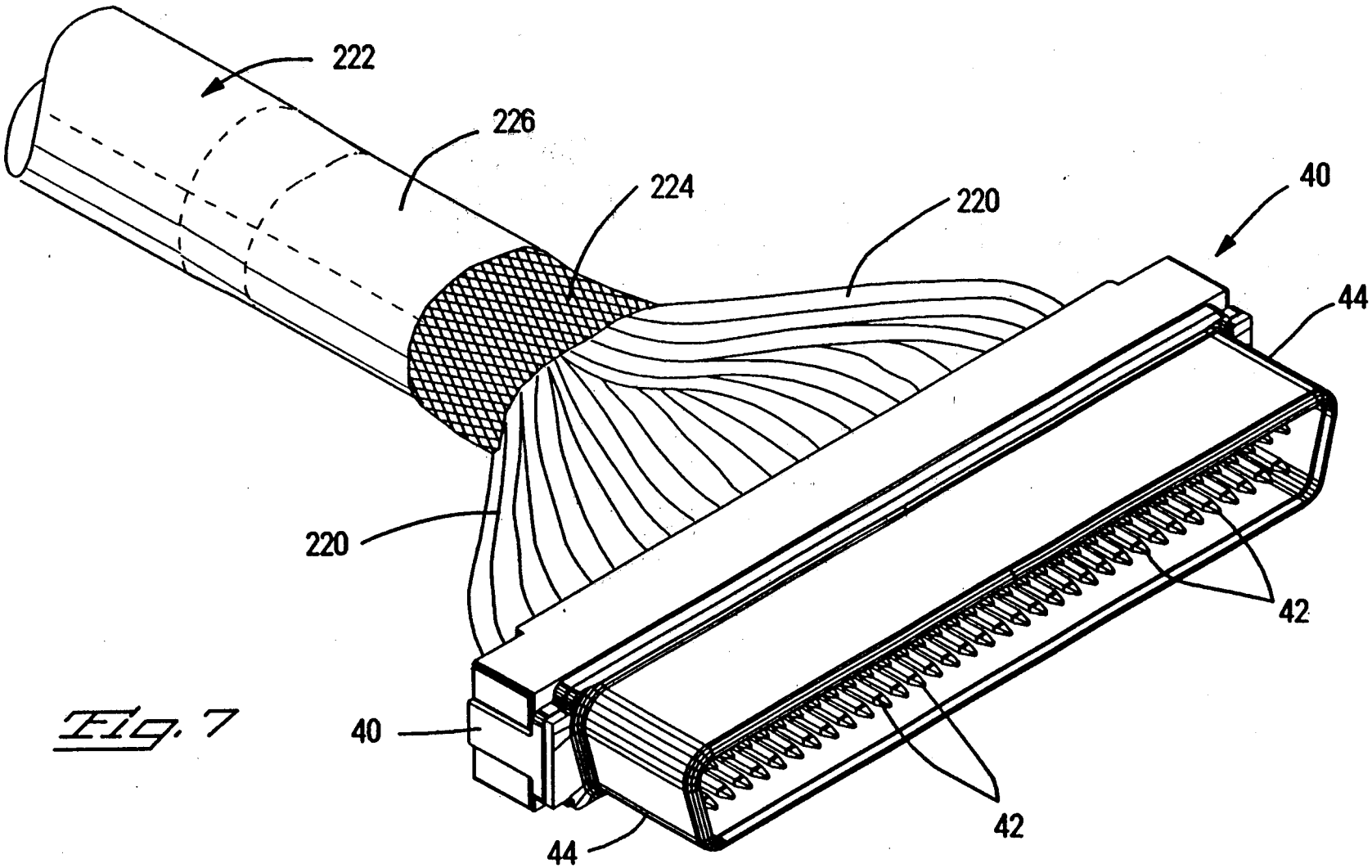
FIG. 7 is a perspective view of a cable terminated to a contact holding member.

Housing 40 having contacts 42 terminated to conductors 220 of a shielded cable 222 having braided shield 224 is shown in FIG. 7. The jacket 226 of cable 222 has been removed a predetermined distance from the end of the cable, the conductors 220 have been terminated to respective contacts 42 and the shield 224 has been folded back over the end of the jacket. As stated above, such a housing and its termination to conductors is disclosed in U.S. Pat. No. 4,781,615.

Figure 10:
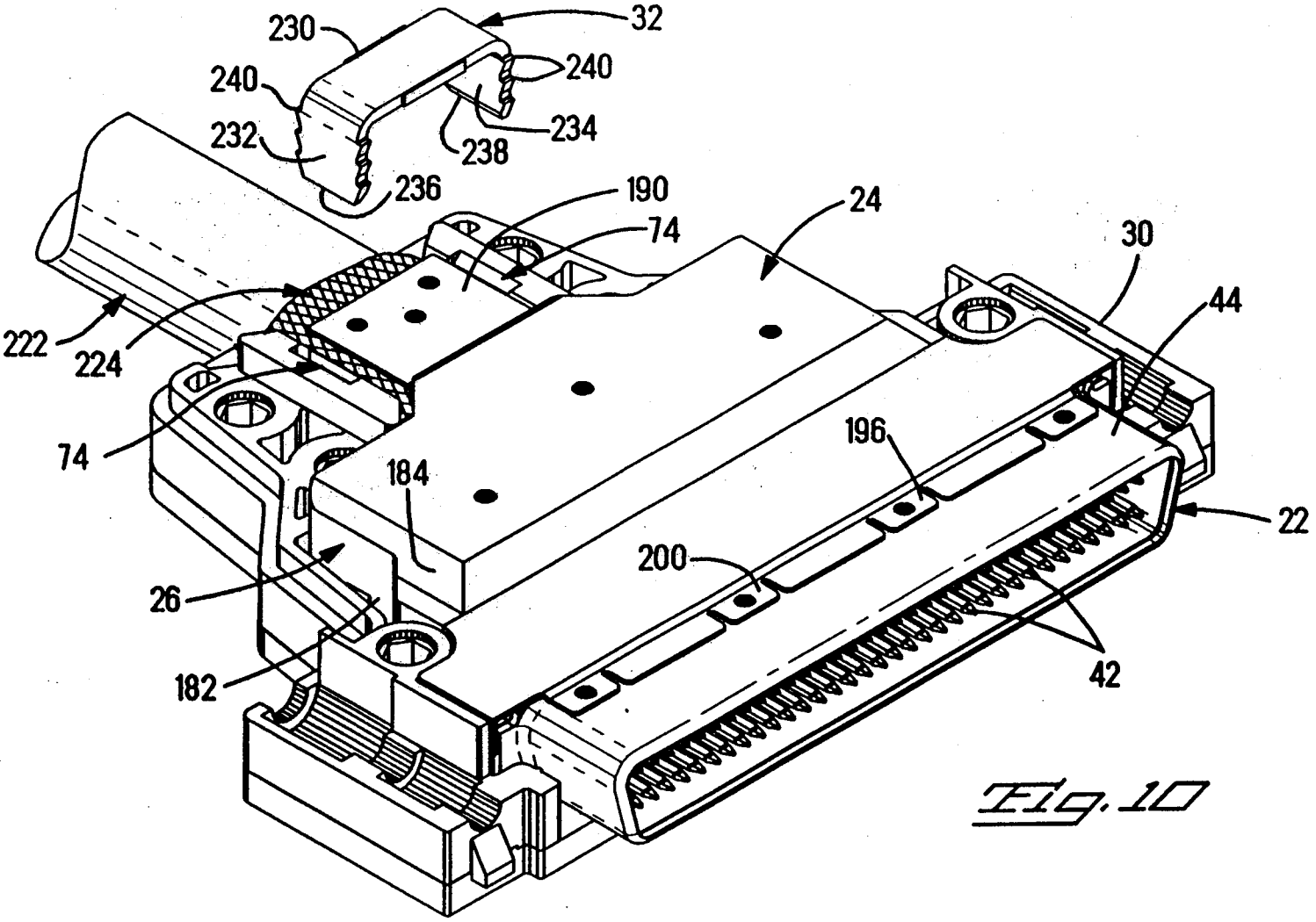
FIG. 10 is a perspective view showing the subassembly of FIG. 9 with the upper shield positioned thereon, with a staple position thereover for assembly thereto.

Staple 32 is disclosed in U.S. Pat. No. 4,842,547 which is hereby incorporated by reference. As best seen in FIG. 10, staple 32 in the preferred embodiment is made of steel and has a bight 230 with two legs 232 and 234 extending therefrom to respective free ends 236 and 238 which may be tapered to facilitate insertion into channels 74. Each leg is rectangular in cross section have major surfaces and minor edges, with barbs 240 on the minor edges. The tip-to-tip dimension of barbs 240 may be progressively larger in a direction away from free ends 236 and 238. The staple and barbs 240 are sized to provide an interference fit with sidewalls 78 and 82 when staple 32 is pressed into channels 74.

Figure 8:
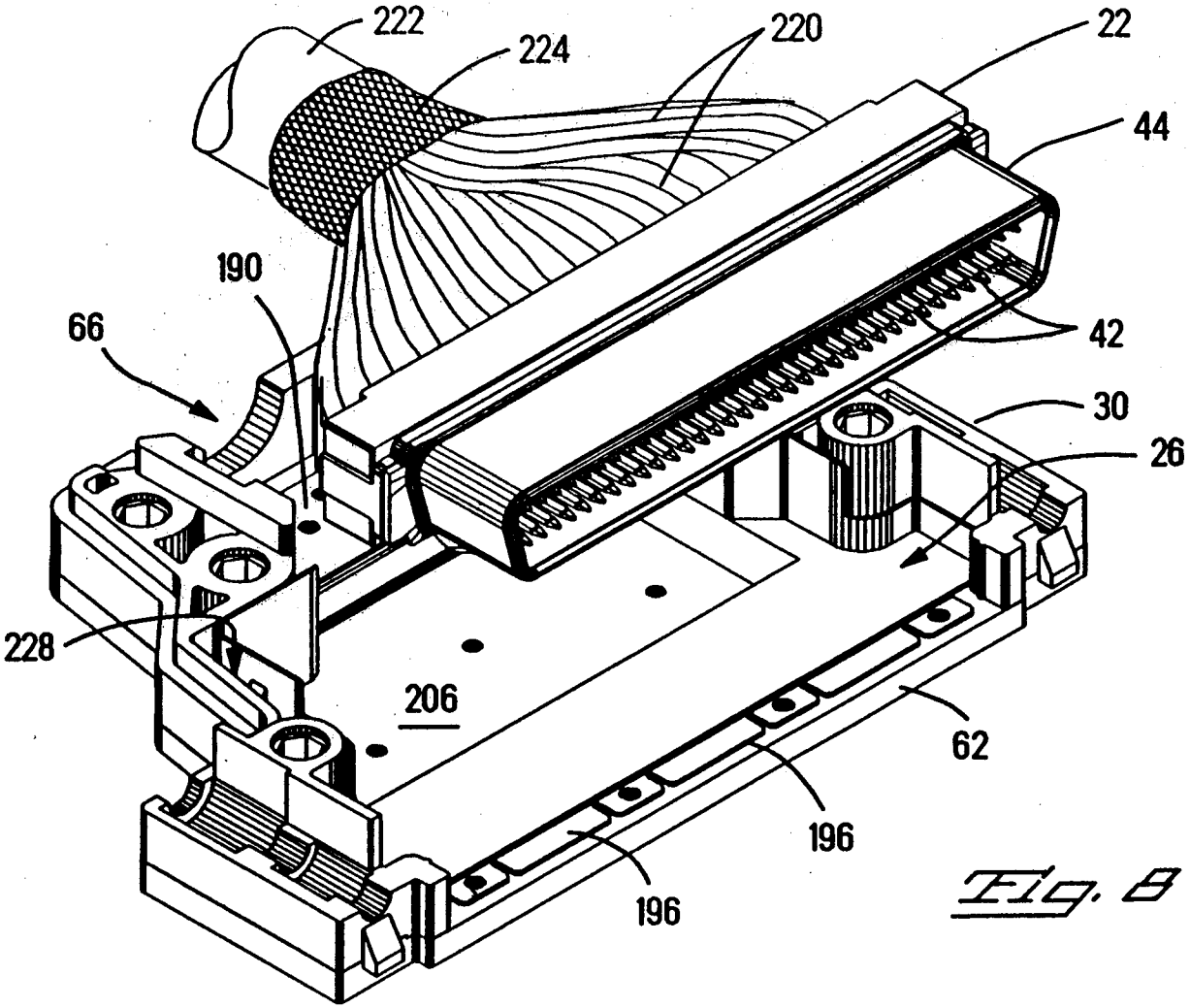
FIG. 8 is a perspective view of a shield of FIG. 5 disposed within the cavity of the lower backshell of FIG. 3 with the contact holding member terminated to a cable positioned thereover for assembly thereto.

FIGS. 8 through 12 are a series of Figures showing the assembly of connector 20, once contacts 42 of housing 40 have been terminated to respective conductors 220 of shielded cable 222. As shown in FIG. 8, lower shield 26 has been positioned in cavity 64 of lower backshell 30. Flange 190 extends over transverse boss 84 in cable exit 66. Spring fingers 196 are positioned proximate forward edge 62 and extend upwardly from the inside surface of lower backshell 30 so that they may be resiliently engaged by shell 44. Housing 40 with conductors 220 of shielded cable 222 terminated to respective ones of contacts 42, and with shield 224 folded back over the leading edge of jacket 226, is positioned over the previous subassembly to be received in cavity 206 of lower shield 26 of the thus far assembled subassembly. It should be observed there is a small space 228 between the exterior surface of sidewall 182 and the interior surface of peripheral flange 50.

Figure 9:
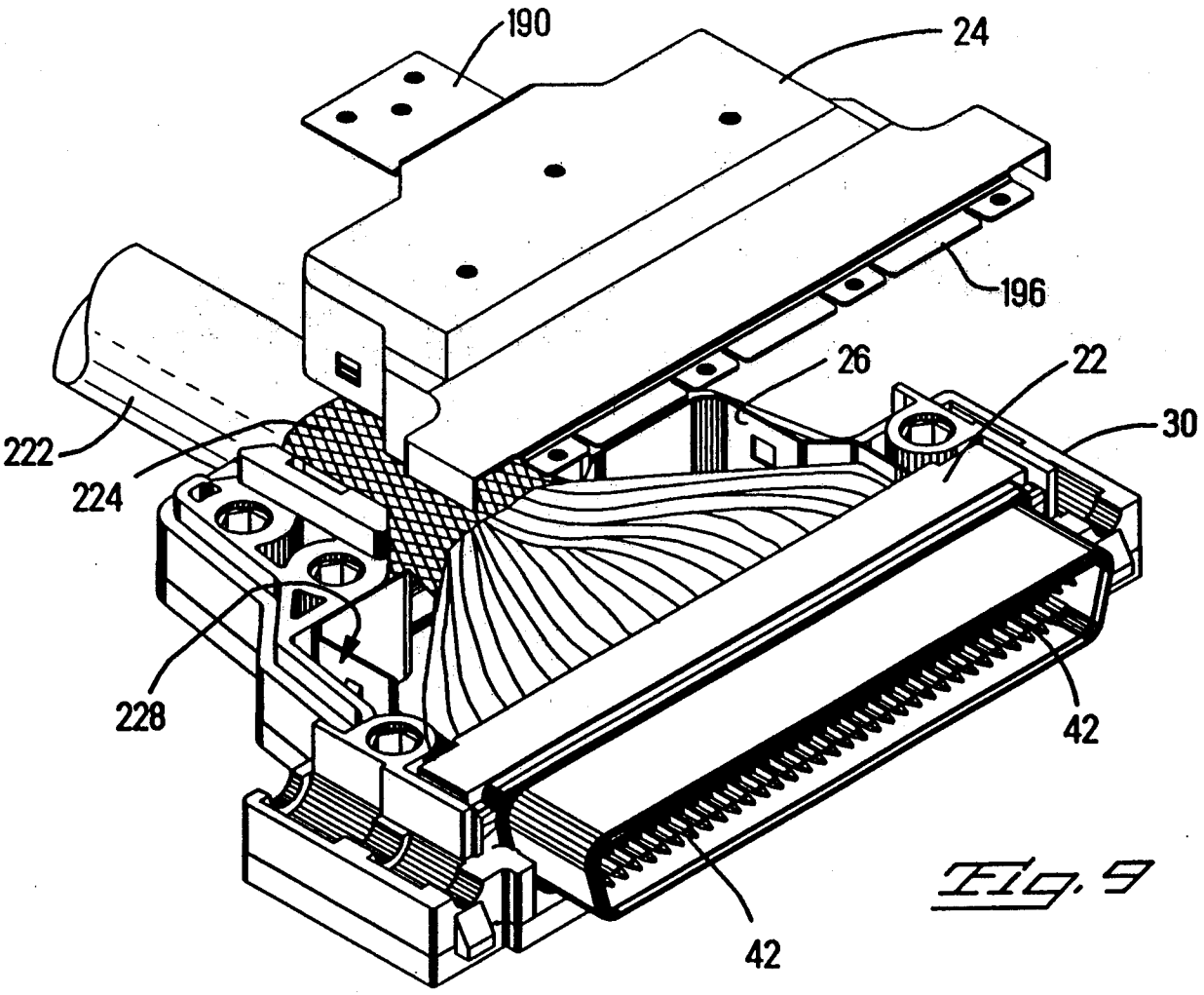
FIG. 9 is a perspective view showing the subassembly of FIG. 8 with the contact holding member received therein, with an upper shield positioned thereover for assembly thereto.

FIG. 9 shows housing 40 received in lower shield 24 and lower backshell 30, with the cable shield 224 positioned over flange 190 of lower shield 26. Upper shield 26 is positioned to be received over the thus far assembled subassembly.

FIG. 10 shows the upper shield 24 received in position in the partial subassembly. Flange 190 extends into the cable exit 66 and thus over the prepared shield 224 of shielded cable 222. Spring fingers 196 resiliently engage shell 44. Spring fingers 196, and if present bosses 200, engage the elongate upper surface of shielding shell 44 on housing 40. As upper shield 24 is moved (downward in FIG. 9) into position, sidewall 184 of upper shield 24 is received outside sidewall 182 of lower shield 26 in space 228 at lateral side 52 and concomitantly protrusion 202 of lower shield 26 is received in aperture 204 of upper shield 24. Concurrently, sidewall 182 of upper shield 24 is received inside sidewall 184 of lower shield 26 at the other lateral side 54 and concomitantly protrusion 202 of upper shield 24 is received in aperture 204 of lower shield 26 to secure the two shields together. Staple 32 is positioned over cable exit 66 and concomitantly flange 190, aligned with channels 74 for disposition therein. Typically, a press will be used to insert staple 32 to a predetermined depth. The predetermined depth is dependent upon the size of the cable, the size of the opening, the cross sectional area of the cable exit and the amount of reduction of the cross sectional area of the cable desired.

Figure 11:
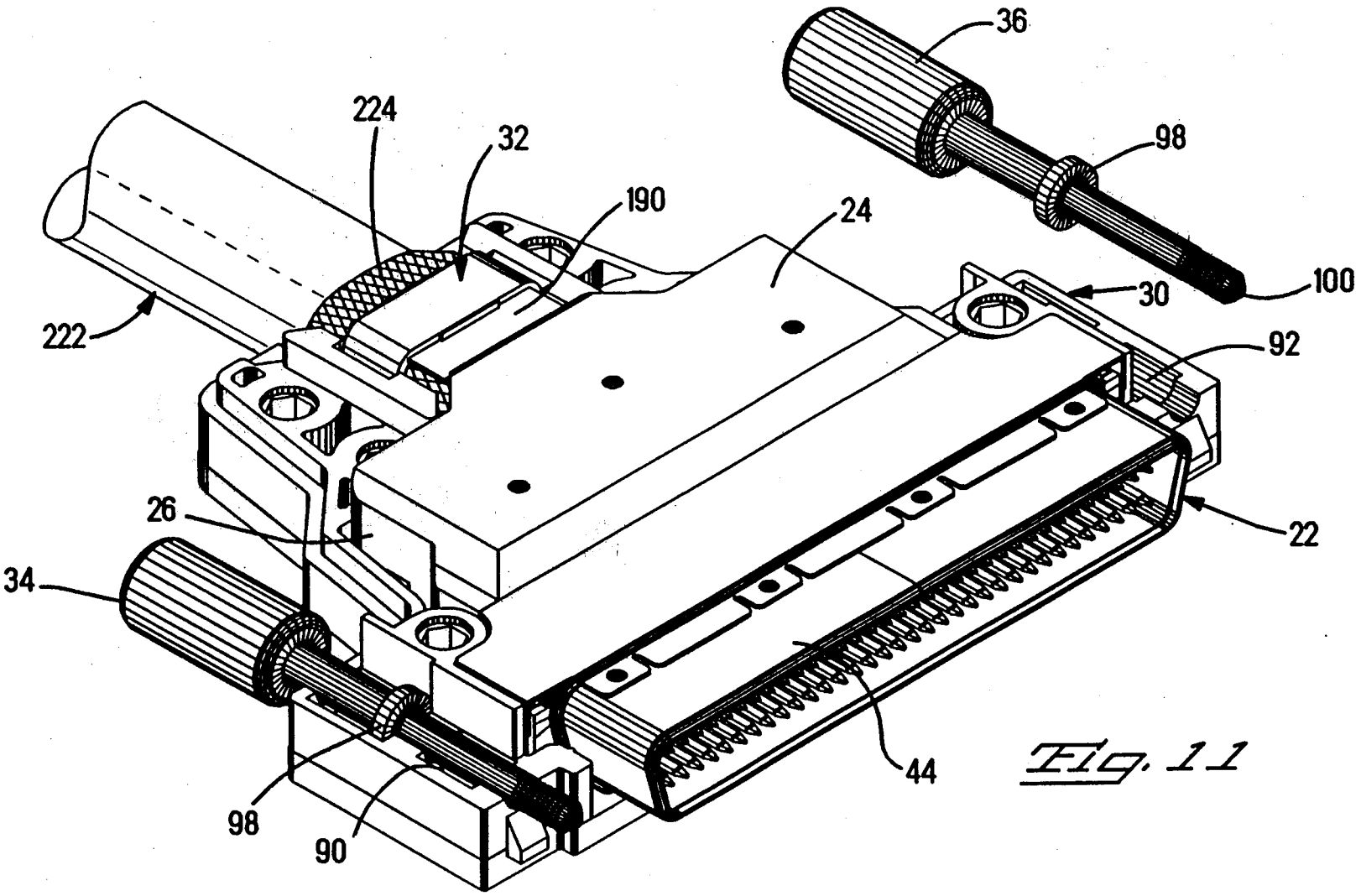
FIG. 11 is a perspective view showing the subassembly of FIG. 10 with the staple secured to the lower housing, with a jack screw positioned in a first jack screw channel in the lower backshell, and a second jack screw positioned over a second jack screw channel for disposition therein.

As shown in FIG. 11, staple 32 has been secured to lower backshell 30 by being pressed (tooling not shown) into channels 74 to complete the electrical path from shielding shell 44 through the spring fingers 196 and one or both of shields 24 and 26 and their respective flanges 190 to the shield 224 on shielded cable 222. Jack screw 34 has been positioned in jack screw receiving channel 90 and jack screw 36 is positioned to be received in jack screw receiving channel 92.

Figure 12:
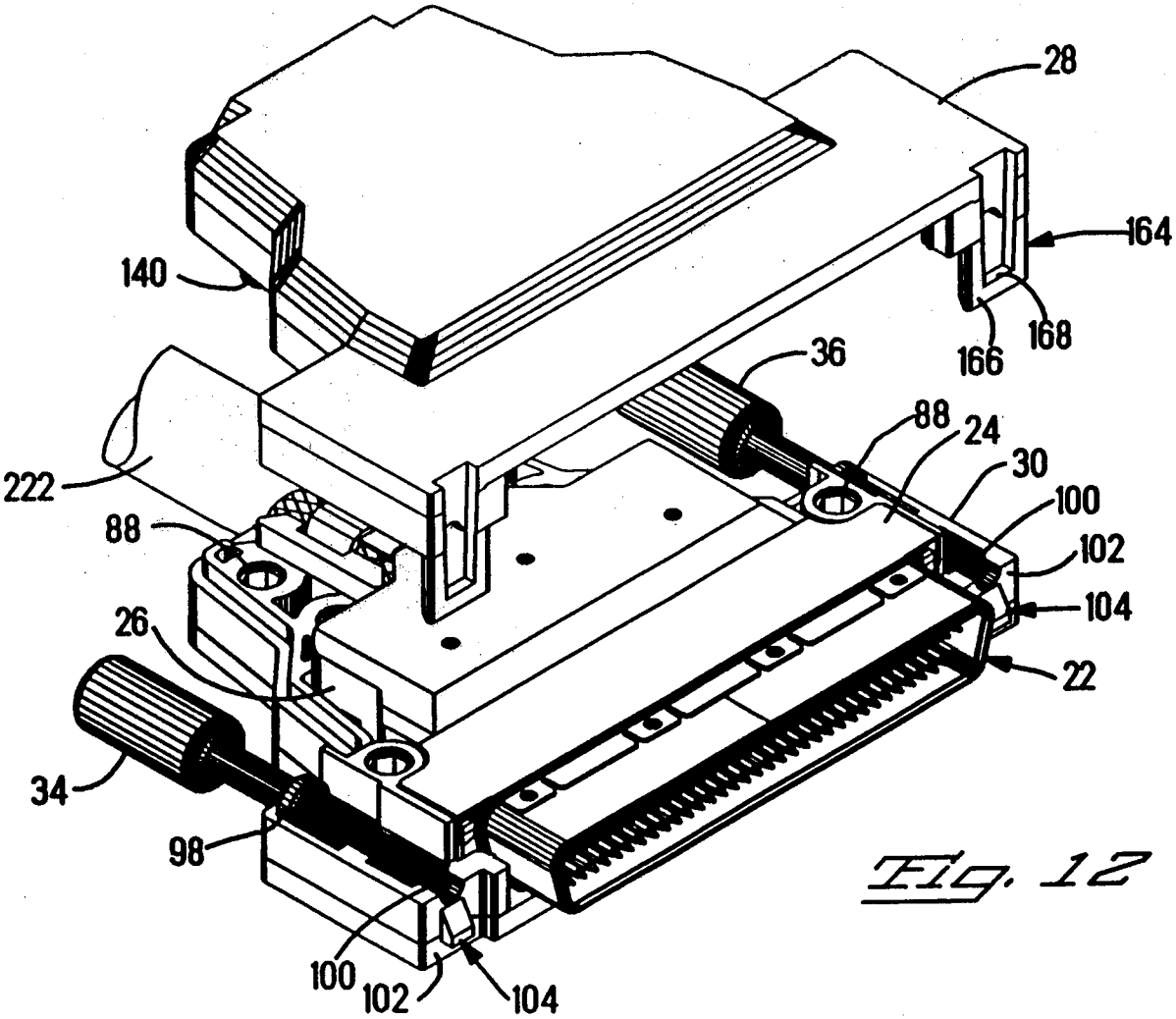
FIG. 12 is a perspective view showing the subassembly of FIG. 11 with the second jack screw disposed in the second jack screw channel and the upper backshell positioned over the resulting subassembly.

In FIG. 12, jack screw 36 has been positioned in jack screw receiving channel 92 and upper backshell 28 has been positioned above the thus far completed subassembly for positioning thereon. Posts 140 in upper backshell 28 are aligned with respective recesses 88 in which they will be received in lower backshell 30. Jack screws 34 and 36 are axially positioned with enlarged region 98 against rear stop 94 so that ends 100 do not extend beyond surface 102 and therefore do not interfere with latches 164. Latches 164 are vertically aligned with surfaces 102, positioned for latch 164 to pass over latch protrusions 104 to secure upper backshell 28 to lower backshell 30.

Figure 2:
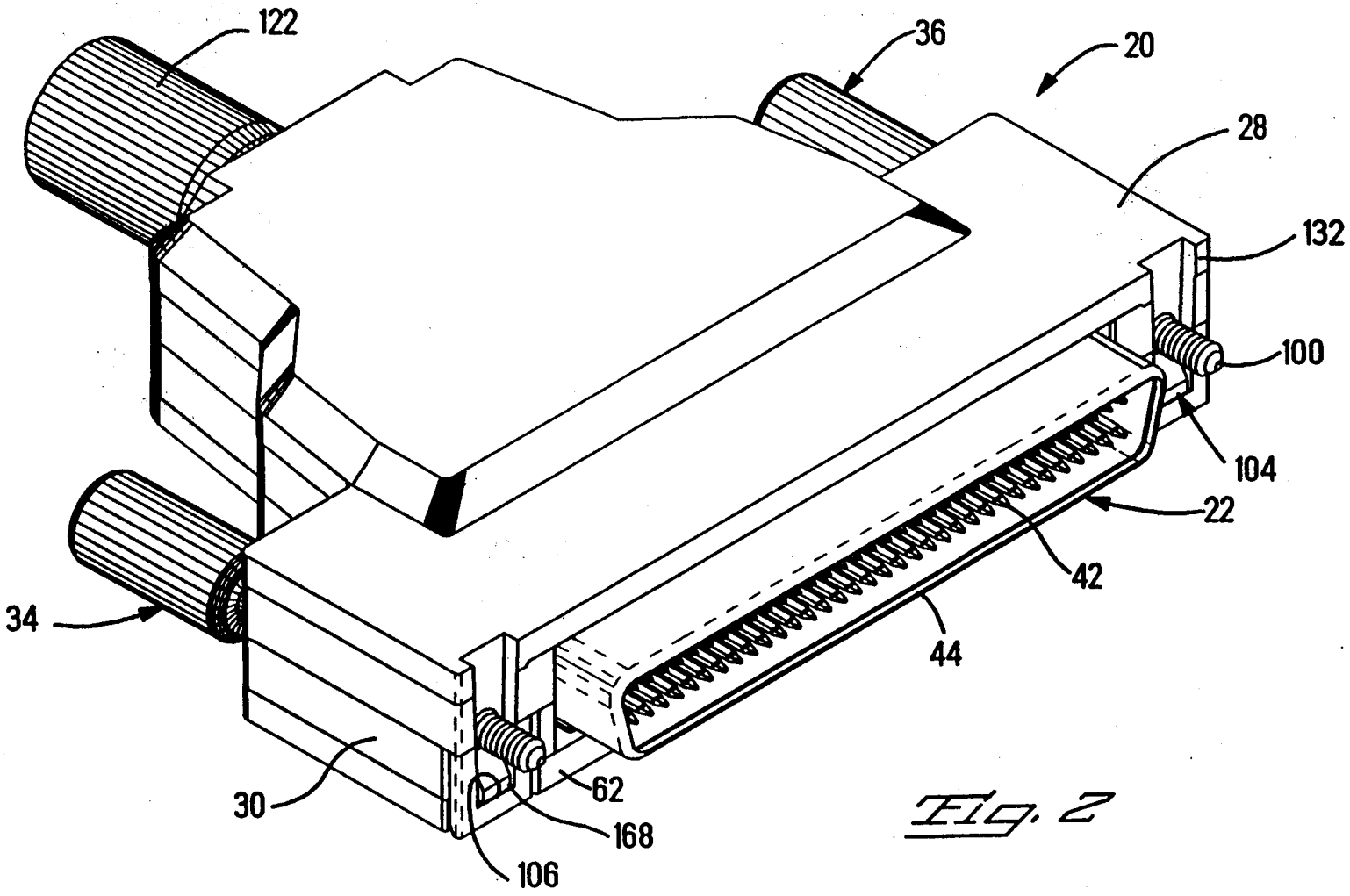
FIG. 2 is a front perspective view of the connector of FIG. 1, terminated to a cable.

The final assembly of connector 20, terminated to conductors of a shielded cable, is shown in FIG. 2 where latch shoulder 168 can be seen engaging latch shoulder 106 to supplement the retention provided by posts 140 being received in recesses 88 in an interference fit. Ends 100 of jack screws 34 and 36 are free to pass through latch 164 to threadingly engage a mating connector.

Figure 13:
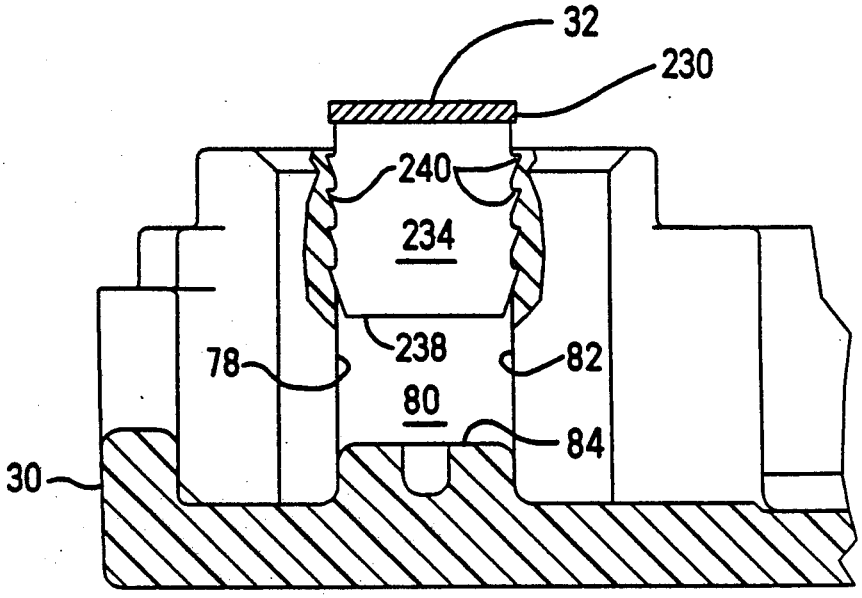
FIG. 13 is a partial sectional view through the cable exit, with the cable removed for clarity, showing the staple partially inserted therein.

FIG. 13 shows a partial sectional view through the cable exit 66, with the cable and shields removed for clarity. Staple leg 234 is partially inserted into a channel 74. Barbs 240 of staple 32 are shown engaging sidewalls 78 and 82 in an interference fit to provide retention for the staple once pressed in channel 74.

Figure 14:
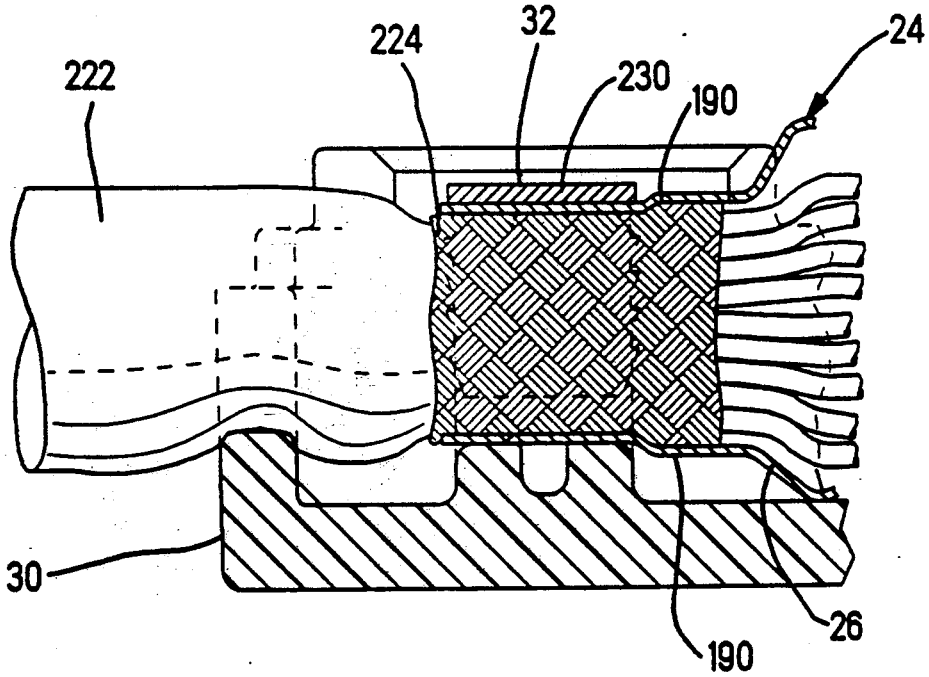
FIG. 14 is a partial sectional view through the cable exit, similar to FIG. 13, showing the restrained cable and in addition engagement between the staple and the shield flanges as well as engagement between the staple and shield flanges and the cable shield.

FIG. 14 shows a partial sectional view similar to FIG. 13 in which the restrained cable 222 is shown with staple 32 in final position. Cables 22 has been compressed somewhat to provide strain relief. The bight 230 of staple 32 presses on flange 190 of upper shield 24 which in turn presses on the shield 224 at the top of now somewhat flattened cable 222. Cable 222 is compressed as a result of the force imparted thereto by the staple on flange 190 of the upper shield. The shield 224 is pressed against flange 190 of lower backshell 26 which is supported by transverse boss 84. In this manner, strain relief is provided to cable 222 while simultaneously assuring good mechanical and electrical interconnection between shield 224 and flanges 190 of shields 24 and 26. While the preferred embodiment employs two flanges, one on each of the shields, being compressed by the staple against shield 224 to provide electrical continuity therebetween, one such flange commoned with shield 224 will suffice.

FIG. 15 is a partial sectional view of the assembled connector, on an enlarged scale, showing engagement between the upper and lower shields 24 and 26, and shell 44. In this manner, when connector 20 is mated to a mating connector (not shown) shielding on the mating connector engages shield 44 and is electrically common with the shield 224 of shielded cable 222 through one or both of shields 24 or 26. Shield 44 is commoned to the shields 24 and 26 through spring fingers 196 and more specifically bosses 200 if present. Shields 24 and 26 are electrically commoned with shield 224 through compressive engagement of flange 190 with shield 224 when the strain relief compression of the cable is effected, that is when staple 32 is pressed into channels 74. Various cable diameters can be accommodated by judiciously inserting staple 32 to predetermined depths.

While the invention has been described as having plastic backshells 28 and 30, and separate shield members 24 and 26, the invention is not limited thereto. It is contemplated within the scope of the invention that metal coated plastic backshells such as are known in the art could be used, obviating the need for separate shield members 24 and 26. With the use of metal coated plastic backshells, the staple would press directly against the cable shield and reduce the cross sectional area of the cable. On the side of the cable opposite from the bight of the staple, the cable shield would be pressed against the electrically conductive metal coating on the surface of the cable exit, such as across transverse boss 84, to establish electrical continuity between shield 224 and the electrically conductive metal coating. Metal coated plastic spring members on the backshells, analogous to the spring fingers 196, would provide electrical conductivity between shell 44 and the electrically conductive metal coating on the backshells.

Figure 16:
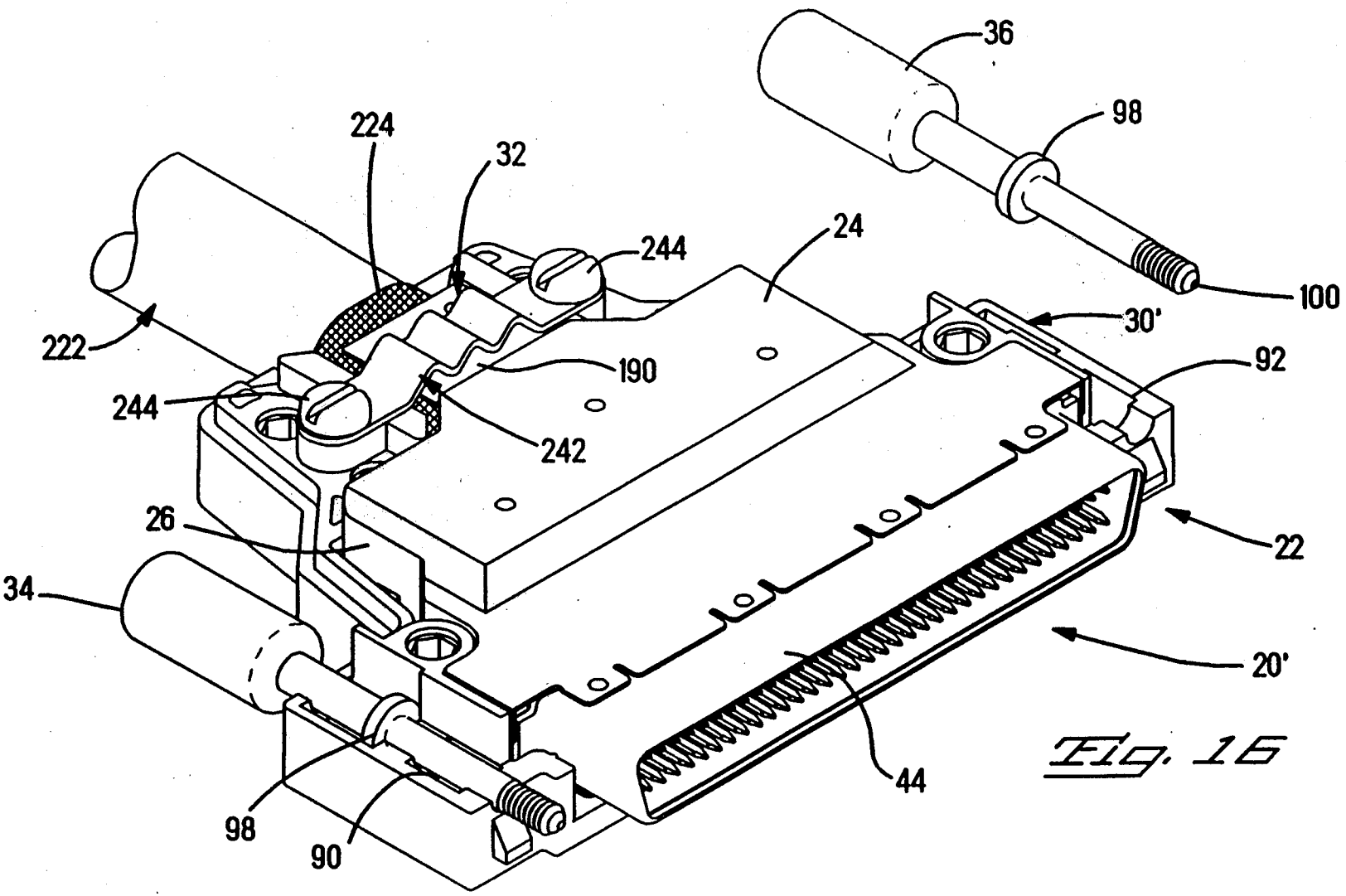
FIG. 16 is an alternate embodiment connector, at the stage of assembly of the connector shown in FIG. 11, with a wave clamp providing strain relief and simultaneously electrical continuity.

In an alternate embodiment connector 20' shown in FIG. 16, an alternative structure for providing the compressive force is disclosed. In the alternate embodiment, lower backshell 30' accommodates self tapping screws 244 to secure a wave clamp 242 that applies pressure to flange 190, if present, or directly to cable shield 224. A wave clamp is disclosed in U.S. Pat. No. 4,952,168, the disclosure of which incorporated by reference. Wave clamp 242 provides the same functions of providing strain relief and simultaneously assuring mechanical engagement, and therefore concomitantly electrical continuity, between the wave clamp and upper shield specifically the flange thereof, the upper shield specifically the flange thereof and the cable shield, and the cable shield and lower shield specifically the flange thereof.

Just as with the embodiment utilizing a staple, the wave clamp could be used with a metal coated insulative or plastic housing. In the absence of the flange, the wave clamp would directly engage the shield on the cable and the shield on the cable would directly engage the metal coating on the interior of the cable exit of the lower backshell to provide electrical continuity therebetween. Metal coated plastic spring members on the backshells, analogous to the spring fingers 196, would provide electrical continuity between shell 44 and the metal coating on the backshells.

We claim:

1. An electrical connector for terminating to conductors of a shielded cable, the cable having at least an region with an exposed cable shield, the connector comprising:

an insulated housing member having a cavity therein, the insulated housing member having a cable exit between the cavity and an exterior surface thereof;

a shield member receivable in the cavity, said shield member having a flange extending into the cable exit; and a pressure member adapted to be received and secured in said cable exit, said pressure member adapted to be moved into the cable exit to compress a cable passing therethrough and to be secured to the insulated housing member proximate the cable exit such that the shield member flange is pressed into engagement with the exposed cable shield on the cable, whereby strain relief is provided and simultaneously electrical continuity is achieved between the cable shield and the flange.

2. An electrical connector as recited in claim 1, wherein the pressure member is a staple.

3. An electrical connector as recited in claim 1, wherein the pressure member is a clamp.

4. An electrical connector as recited in claim 2, wherein the staple is electrically conductive.

5. An electrical connector as recited in claim 2, wherein the staple is received in the cable exit in an interference fit.

6. An electrical connector as recited in claim 1, further comprising a contact holder having an electrically conductive shell thereon, said shield member engaging and being electrically conductive with said shell, whereby the shell is electrically commoned with the cable shield through the shield member.

7. An electrical connector as recited in claim 1, further comprising a second insulated housing member securable to said insulated housing member.

8. An electrical connector as recited in claim 2, further comprising staple leg receiving channels in said cable exit.

9. An electrical connector as recited in claim 8, wherein said staple has a bight and two legs, said legs receivable in the staple leg receiving channels.

10. An electrical connector as recited in claim 8, wherein said staple has protrusions for engaging the walls of the staple leg receiving channels to secure the staple in the insulated housing member.

11. An electrical connector as recited in claim 2, wherein said staple has protrusions for engaging walls of the cable exit to secure the staple in the insulated housing member.

12. An electrical connector as recited in claim 11, wherein the protrusions engage walls of the cable exit in an interference fit.

13. An electrical connector for terminating to conductors of a shielded cable, the cable having an exposed cable shield, the connector comprising:

an insulated housing member having a cavity therein, the insulated housing member having a cable exit between the cavity and an exterior surface thereof;

a first shield member receivable in the cavity, said first shield member having a flange extending into the cable exit;

a second shield member engageable with and thereby electrically commoned with said first shield member; and a staple adapted to be received and secured in said cable exit, said staple adapted to be moved into the cable exit to compress a cable passing therethrough such that the flange of said first shield member is pressed into engagement with the exposed cable shield on the cable, whereby strain relief is provided and simultaneously electrical continuity is achieved between the cable shield and the flange.

14. An electrical connector as recited in claim 13, wherein the staple is electrically conductive.

15. An electrical connector as recited in claim 13, wherein the staple is received in the cable exit in an interference fit.

16. An electrical connector as recited in claim 13, further comprising a contact holder having an electrically conductive shell thereon, one of said shield members with said shell, whereby the shell is electrically commoned with the cable shield through one of said shield member.

17. An electrical connector as recited in claim 13, further comprising a second insulated housing member securable to said insulated housing member.

18. An electrical connector as recited in claim 13, further comprising staple leg receiving channels in said cable exit.

19. An electrical connector as recited in claim 18, wherein said staple has a bight and two legs, said legs receivable in the staple leg receiving channels.

20. An electrical connector as recited in claim 18, wherein said staple has protrusions for engaging the walls of the staple leg receiving channels to secure the staple in the insulated housing member.

21. An electrical connector as recited in claim 13, wherein said staple has protrusions for engaging walls of the cable exit to secure the staple in the insulated housing member.

22. An electrical connector as recited in claim 21, wherein the protrusions engage walls of the cable exit in an interference fit.

23. A method of providing electrical continuity between a shield of a cable and a shield within a cable exit of an insulative housing, the method comprising the steps of:

positioning the shield member within the cable exit of the insulative housing, inserting the cable along the cable exit of the insulative housing with a shield of the cable being exposed and placed against the shield member within the cable exit, assembling a staple over the cable and applying compression of the staple against the cable to apply pressure between the shield of the cable and the shield member for establishing electrical continuity therebetween, and securing the staple to the housing to secure the cable and to maintain said electrical continuity.

24. A method of providing electrical continuity between a shield of a cable and a shield within a cable exit of an insulative housing, the method comprising the steps of:

positioning the shield member within the cable exit of the insulative housing, inserting the cable along the cable exit of the insulative housing with a shield of the cable being exposed and placed against the shield member within the cable exit, assembling a clamping member over the cable and applying compression of the clamping member against the cable to apply pressure between the shield of the cable and the shield member for establishing electrical continuity therebetween, and securing the clamping member to the housing to secure the cable and to maintain said electrical continuity.

* * * * *